United States Patent [19]

Takeyama

[11] 4,047,146

[45] Sept. 6, 1977

[54] VARIABLE RESISTOR ASSEMBLY

[75] Inventor: Fumimasa Takeyama, Miyagi, Japan

[73] Assignee: Alps Electric Co., Ltd., Tokyo, Japan

[21] Appl. No.: 717,901

[22] Filed: Aug. 26, 1976

[30] Foreign Application Priority Data

| | | |
|---|---|---|
| Jan. 14, 1976 | Japan | 51-3042[U] |
| Jan. 14, 1976 | Japan | 51-3043[U] |
| Jan. 14, 1976 | Japan | 51-3044[U] |
| Jan. 14, 1976 | Japan | 51-3045[U] |

[51] Int. Cl.[2] ..... H01C 10/38

[52] U.S. Cl. ..... 338/176; 338/184; 338/199

[58] Field of Search ..... 338/160, 161, 165, 167, 338/164, 184, 183, 199, 176, 179, 188, 202

[56] References Cited

U.S. PATENT DOCUMENTS

| | | | |
|---|---|---|---|
| 3,622,934 | 11/1971 | Yano | 338/179 X |
| 3,639,880 | 2/1972 | Oka | 338/183 |
| 3,671,915 | 6/1972 | Sasaki et al. | 338/183 |
| 3,887,892 | 6/1975 | Rozema et al. | 338/183 |

*Primary Examiner*—C. L. Albritton
*Attorney, Agent, or Firm*—Guy W. Shoup

[57] ABSTRACT

An insulating casing is formed with one open end and a longitudinal slot through one wall. A plug member is detachably fixed to the casing by means of interlocking projections and arms to close the open end of the casing. The plug member is formed with a shield plate which coextensively extends through the interior of the casing. A slider member is formed with a slot through which the shield plate slidably extends and an actuating handle extending through the longitudinal slot in the casing. A resistance plate is disposed between the slider and a wall of the casing opposite to the wall through which the longitudinal slot is formed. The resistance plate is formed with a resistance element with which a slider contact fixed to the slider member slidingly engages.

8 Claims, 10 Drawing Figures

Fig. 1
PRIOR ART
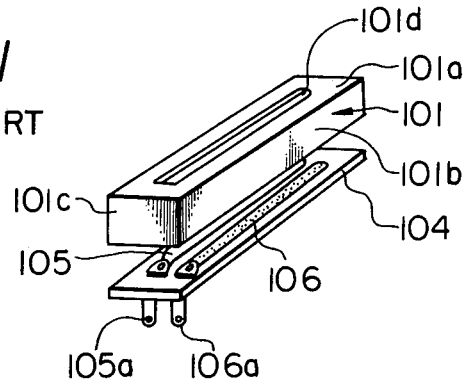
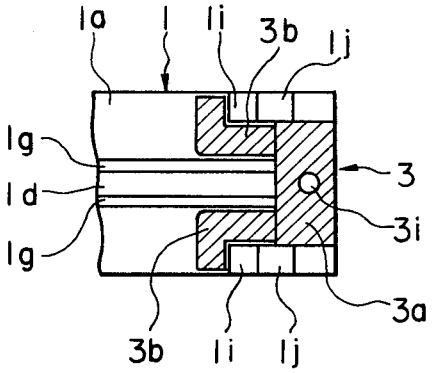
Fig. 3
Fig. 4
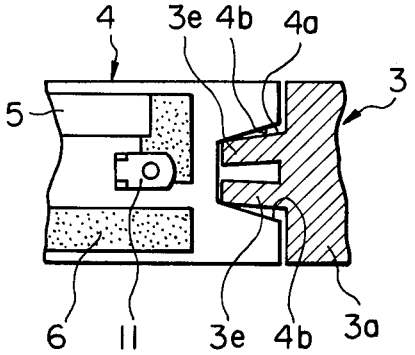

VARIABLE RESISTOR ASSEMBLY

BACKGROUND OF THE INVENTION

The present invention relates to a variable resistor assembly for electronics applications which is operative either as a rheostat or a potentiometer.

Variable resistors are generally known in the art. However, various problems are inherent in known variable resistors. A typical drawback is that prior art variable resistors generally comprise a metal casing which is dangerous from the shock hazard aspect if one of the terminals or internal resistance elements should become shorted to the casing. A drawback generally found in the type of variable resistor having a linearly disposed resistance element to which the present invention relates is that a slot is formed through one wall of the casing through which a handle for moving a slider contact protrudes. The resistance element and slider contact are susceptible to dirt entering the casing through the slot which degrades the materials of the slider contact and resistance element and also the ohmic contact therebetween.

SUMMARY OF THE INVENTION

It is therefore an object of the present invention to provide a variable resistor assembly adapted to overcome the drawbacks of the prior art which comprises an electrically insulative casing formed with an open end and a plug member detachably fixed to the casing to close the open end. A shield plate extending from the plug member coextensive with the interior of the casing slidingly extends through a slider member to provide a barrier between a slot for a slider actuating handle formed through the casing and a slider member and resistance element with which the slider member slidingly engages.

The above and other objects, features and advantages of the present invention will become clear from the following detailed description taken with the accompanying drawings.

BRIEF DESCRIPTION OF THE DRAWING

FIG. 1 is an exploded view of a prior art variable resistor assembly;

FIG. 3 is an overhead plan view showing the connection of the plug member with the casing;

FIG. 4 is a plan view from below showing the connection of the resistance member with the plug member;

DESCRIPTION OF THE PREFERRED EMBODIMENTS

Figure 2A:
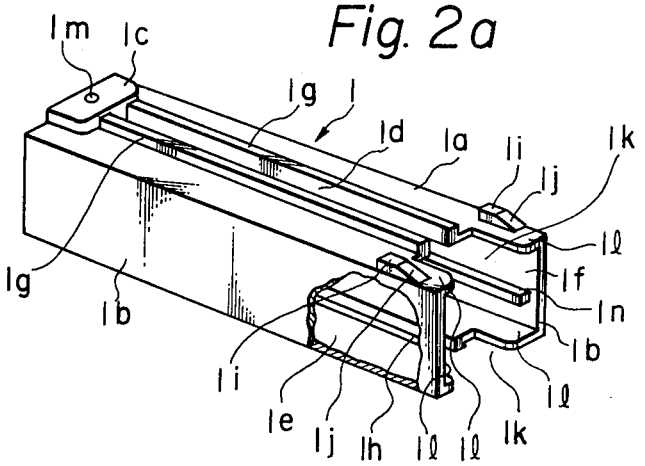
FIG. 2*a* is a perspective view of a casing of a variable resistor assembly embodying the present invention.
Figure 2C:
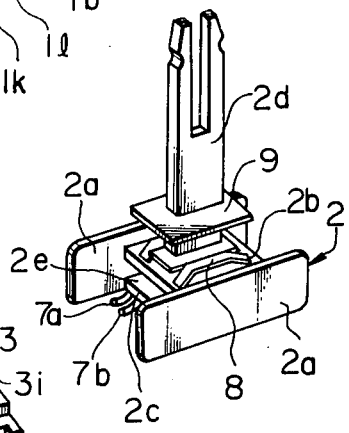
FIG. 2*c* is a perspective view of a slider member of the present variable resistor assembly.
Figure 2B:
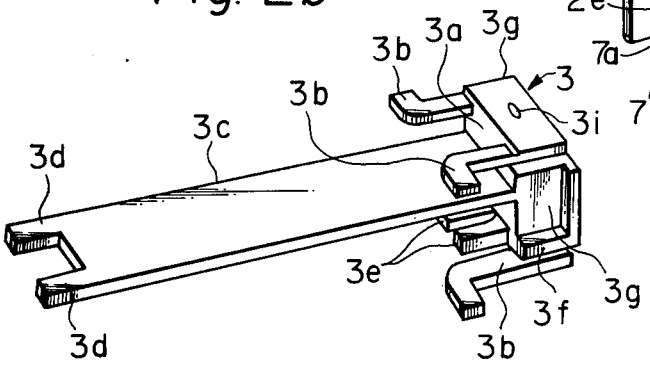
FIG. 2*b* is a perspective view of a plug member of the present variable resistor assembly.
Figure 2D:
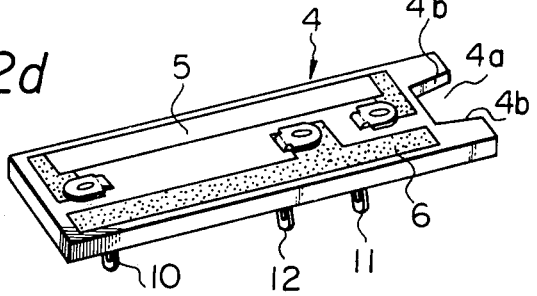
FIG. 2*d* is a perspective view of a resistance member of the present variable resistor assembly.
Figure 5:
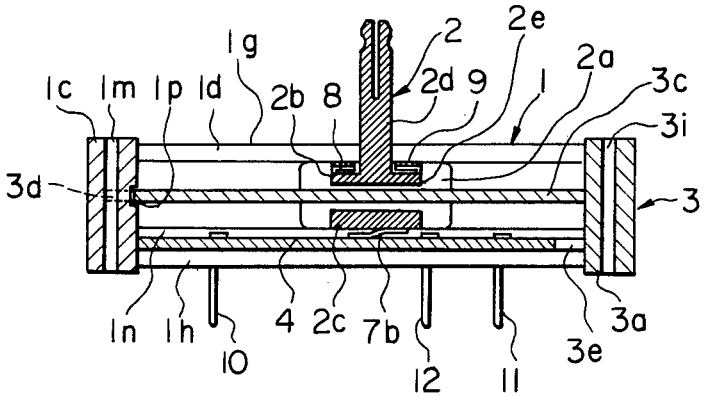
FIG. 5 is a longitudinal sectional view of the assembled variable resistor assembly.
Figure 6:
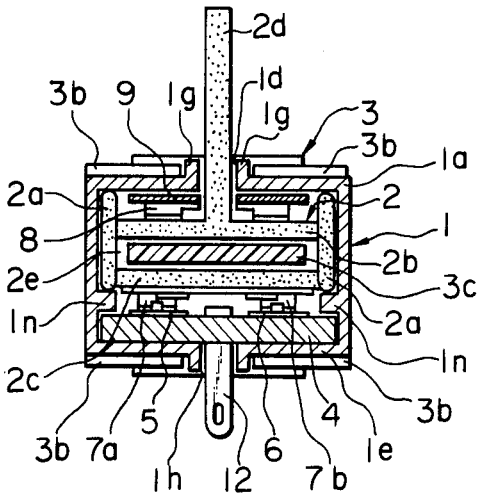
FIG. 6 is a transverse sectional view of the variable resistor assembly.

While the variable resistor assembly of the invention is susceptible of numerous physical embodiments, depending upon the environment and requirements of use, substantial numbers of the herein shown and described embodiments have been made, tested and used, and all have performed in an eminently satisfactory manner.

Referring now to FIG. 1 of the drawings, a prior art variable resistor assembly comprise a metal electrically conductive casing 101 formed with a longitudinal slot 101*d* in an upper wall 101*a* thereof. The casing 101 has closed side walls 101*b*, closed end walls 101*c* and an open bottom. An electrically insulative resistance member 104 is fitted to the open bottom of the casing 101 by fastening means (not shown) and has formed thereon a resistance element 105 and an elongated conductor 106 which extends parallel to the resistance element 105. Terminals 105*a* and 106*a* are connected to the resistance element and the conductor 106 respectively. Although not shown, another terminal may be provided at the opposite end of the resistance element 105 so that the variable resistor assembly may be used either as a rheostat or a potentiometer. A slider member which is not shown is adapted to be slidable along the interior of the casing 101 by means of a handle extending through the slot 101*d*. A slider contact (not shown) of the slider member bridges the resistance element 105 and conductor 106 at various positions thereof to provide correspondingly different resistance values between the terminals 105*a* and 106*a*.

The prior art variable resistor assembly shown in FIG. 1 suffers from the drawbacks mentioned above in that the conductive casing 101 is a shock hazard and that dirt or other foreign objects such as screwdriver blades may enter the casing through the slot 101*d*. A screwdriver blade or similar metal object can short the resistance element 105 or conductor 106 to the casing 101 or the resistance element 105 and conductor 106 together at an undesired point to damage electrical equipment in which the variable resistor assembly is employed.

A variable resistor assembly embodying the present invention which overcomes these drawbacks is illustrated in FIGS. 2 to 6 and comprises an electrically insulative casing 1 formed of, for example, a plastic material. The casing 1 has an upper wall 1*a*, side walls 1*b* and a bottom wall 1*e*. The casing 1 is further formed with a closed end wall 1*c* and an open end 1*f*. The upper wall 1*a* is formed with a central longitudinal slot 1*d* and guide ridges 1*g* extending from the casing 1 at the edges of the slot 1*d*. A threaded mounting hole 1*m* is provided in the end wall 1*c*. The interior surfaces of the walls 1*b* are formed with longitudinal projections or ridges 1*n* which opposedly face each other. The upper and bottom walls 1*a* and 1*e* are formed with cutouts which are both designated as 1*k* so that four leg portions 1*l* are defined at the open end 1*f* of the casing 1. A central longitudinal opening or slot 1*h* is formed through the bottom wall 1*e*. Projections 1*i* are formed on the legs 1*l* respectively, each projection 1*i* having a ramp 1*j*.

An electrically insulative plug member 3 is adapted to be detachably and sealingly fixed to the casing 1 to close the open end 1*f* by means of an end wall 3*a*. Arms 3*b* extend from the end wall 3*a* so as to ride up the ramps 1*j* of the projections 1*i* and snap down over the ends of the projections 1*i* to lockingly fix the plug member 3 to the casing 1. The end wall 3*a* is formed with a threaded mounting hole 3*i*.

The plug member 3 is further formed with a shield plate 3*c* which extends coextensively into the interior of the casing 1 and is bifurcated at its end 3*d*. The bifurcations 3*d* fit into recesses 1*p* (see FIG. 5) in the end wall 1*c* of the casing 1 to prevent bending of the shield plate 3*c*. The end wall 3*a* is further formed with two projections 3*e* which will be described in detail below. Side faces 3*g* of the end wall 3*a* are formed with L-shaped projections 3*f* which sealingly mate with the open end 1*f* of the casing 1.

A slider member 2 is formed with side members 2*a* and upper and lower transverse members 2*b* and 2*c* respectively which horizontally span the side members 2*a*. The transverse members 2*b* and 2*c* define an opening 2*e* therebetween through which the shield plate 3*c* of the plug member 3 slidingly extends. A handle 2*d* extends from the slider member 2 through the slot 1*d* in the casing 1 by which means the slider member 2 is longitudinally slidable in the casing 1 between the end walls 1*c* and 3*a*. An insulating plate 9 through which the handle 2*d* extends is urged upwardly by a leaf spring 8 into engagement with the inner surface of the upper wall 1*a*. Two slider contacts 7*a* and 7*b* which are made of an electrically conductive material and are electrically integral are fixed to the bottom surface of the slider member 2. The slider member 2 is retained between the ridges 1*n* and the upper wall 1*a* of the casing 1 by means of sliding engagement with the upper and lower edges of the side members 2*a* therewith.

A resistance member 4 is formed of an electrically insulative material and has a resistance element 5 longitudinally formed thereon by means such as printing. Parallel to the resistance element 5 is formed an elongated conductor 6. Terminals 10 and 11 are connected to the opposite ends of the resistance elements 5 and a terminal 12 is connected to the conductor 6. The terminals 10, 11 and 12 are longitudinally spaced on the central axis of the resistance member 4.

The resistance element 4 is inserted into the casing 1 between the ridges 1*n* and the bottom wall 1*e* thereof so as to be fixedly retained. An end of the resistance element 4 is formed with a trapezoidal cutout 4*a* having slant edges 4*b*. As best viewed in FIG. 4, the projections 3*e* of the plug member 3 are resiliently deformed toward each other when the resistance member 4 is assembled in the casing 1 to press the resistance member 4 against the end wall 1*c* of the casing 1 and thereby tightly retain the resistance member 4 in the casing 1. The terminals 10, 11 and 12 extend through the longitudinal opening 1*h* in the bottom wall 1*e* of the casing 1.

The contacts 7*a* and 7*b* of the slider member 2, which are electrically integral, slidingly engage with the resistance element 5 and conductor 6 respectively in the complete variable resistor assembly. If the variable resistor assembly is to be used as a rheostat, the external circuit (not shown) is connected to the terminal 12 and to one of the terminals 10 or 11. The resistance between the connected terminals thereby depends on the position of the slider member 2. If the variable resistor assembly is to be used as a potentiometer, a voltage is applied across the terminals 10 and 11 and the terminal 12 is used as an output terminal. The voltage at the terminal 12 in this case depends on the position of the slider member 2.

It will be understood from the description that the shield member 3*c* serves to shield the resistance member 4 and the slider contacts 7*a* and 7*b* from all foreign objects so that the resistance element 5, conductor 6 and contacts 7*a* and 7*b* cannot be degraded thereby. The ohmic engagement between the contacts 7*a* and 7*b* and resistance element 5 and conductor 6 is maintained effective. The shield member 3*c* positively prevents the resistance element 5 and/or conductor 6 and/or slider contacts 7*a* and 7*b* from being contacted by a screwdriver or other metal object inserted through the slot 1*d*. The only electrical access to the internal components of the variable resistor assembly is at the terminals 10, 11 and 12.

Figure 7:
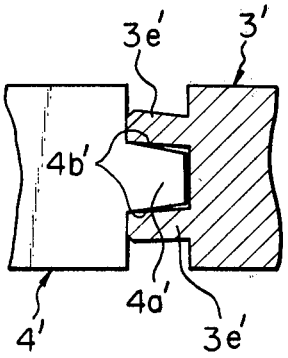
FIG. 7 is a plan view showing an alternative method of connection of the resistance member with the plug member.

An alternative method of resiliently securing the resistance member 4 in the casing 1 is illustrated in FIG. 7. A modified resistance member 4' is formed at its end not with a trapezoidal cutout 4*a* but with a trapezoidal projection 4*a'* having slant edges 4*b'*. A modified plug member 3' has projections 3*e'* similar to the projections 3*e* of the plug member 3 but spaced further apart. The projection 4*a'* of FIG. 7 is adapted to resiliently deform the projections 3*e'* outwardly rather than inwardly as shown in FIG. 4 to tightly retain the resistance member 4' in the casing 1.

It will be noted that plug member 3 is securely but detachably fixed to the casing 1 by means of the projections 1*i* and arms 3*b*, and that no fastening means such as screws or the like are required for the variable resistor assembly. This particular fastening means is exemplary, and many other fastening means may be provided within the scope of the present invention.

What is claimed is:

1. A variable resistor assembly comprising:

an elongated casing having one open end and a longitudinal slot formed through one wall thereof;

a plug member detachably fixed to the casing to close the open end thereof, the plug member having a shield plate extending therefrom coextensive with the interior of the casing;

a slider member formed with a slot through which the shield plate of the plug member slidingly extends, a handle extending from a first side of the slider member through the longitudinal slot of the casing and a slider contact extending from a second side of the slider member which is opposite to the first side thereof; and a resistance member disposed between the second side of the slider member and the casing and being formed with a resistance element with which the slider contact slidingly engages.

2. A variable resistor assembly as in claim 1, in which the casing, plug member, slider member and resistance member are formed of electrically insulative materials, the slider contact being formed of an electrically conductive material and the resistance element being formed of an electrically resistive material.

3. A variable resistor assembly as in claim 1, in which the interior of the casing is formed with opposed longitudinal ridges, the slider member and the resistance member being retained on opposite sides of the ridges respectively.

4. A variable resistor assembly as in claim 1, further comprising a terminal connected to the resistance element, the casing being formed with a longitudinal opening through a wall thereof opposite to said longitudinal slot formed through said one wall thereof, the terminal extending through the longitudinal opening.

5. A variable resistor assembly as in claim 1, in which the slider member further comprises a plate member through which the handle slidingly extends and a spring urging the plate member into engagement with said one wall of the casing through which the longitudinal slot is formed.

6. A variable resistor assembly as in claim 1, in which the resistance member is formed with a trapezoidal cutout and the plug member is formed with two projections to resiliently deformably engage with slant edges of the trapezoidal cutout to retain the resistance member in the casing.

7. A variable resistor assembly as in claim 1, in which the resistance member is formed with a trapezoidal projection and the plug member is formed with two projections to resiliently deformably engage with slant edges of the trapezoidal projection to retain the resistance member in the casing.

8. A variable resistor assembly as in claim 1, in which the casing is formed with a projection at the open end thereof and plug member is formed with an arm to lockingly engage with said projection to fix the plug member to the casing.

* * * * *